US005904103A

United States Patent [19]

Maresh et al.

[11] Patent Number: 5,904,103

[45] Date of Patent: May 18, 1999

[54] CORRUGATED PALLET

[75] Inventors: Mark E. Maresh, Wake Forest, N.C.; John J. Morris, Vestal, N.Y.

[73] Assignee: International Business Machines Corporation, Armonk, N.Y.

[21] Appl. No.: 09/072,426

[22] Filed: May 4, 1998

[51] Int. Cl.[6] ..... B65D 19/00

[52] U.S. Cl. ..... 108/51.3

[58] Field of Search ..... 108/51.3, 901, 108/51.11, 57.34

[56] References Cited

U.S. PATENT DOCUMENTS

| | | | |
|---|---|---|---|
| 2,444,183 | 7/1948 | Cahner . | |
| 2,609,136 | 9/1952 | Sider | 108/51.3 X |
| 3,308,772 | 3/1967 | Thomas, Jr. | 108/51.3 |
| 3,434,435 | 3/1969 | Achermann et al. | 108/51.3 |
| 3,464,371 | 9/1969 | Gifford . | |
| 4,102,525 | 7/1978 | Albano | 108/51.3 X |
| 4,230,049 | 10/1980 | Horne | 108/51.3 X |
| 4,759,295 | 7/1988 | Nilsen et al. | 108/51.3 |
| 4,864,940 | 9/1989 | Dunn | 108/51.3 |
| 5,365,857 | 11/1994 | Kilpatrick et al. . | |
| 5,377,600 | 1/1995 | Speese et al. . | |
| 5,406,892 | 4/1995 | Kilpatrick et al. . | |
| 5,411,786 | 5/1995 | Kuo | 108/51.3 X |
| 5,495,810 | 3/1996 | Yoshii | 108/51.3 |
| 5,660,119 | 8/1997 | Perkins | 108/51.3 |

FOREIGN PATENT DOCUMENTS

| | | |
|---|---|---|
| 26164 | 11/1953 | Finland . |

*Primary Examiner*—Jose V. Chen

*Attorney, Agent, or Firm*—Salzman & Levy; Lawrence R. Fraley

[57] ABSTRACT

A pallet is made of corrugated material having two horizontal, upper and lower deck members. The deck members are substantially parallel to one another. The deck members are separated along their length by a center support member, two vertical side support, stringer members, and at least three separate internal members, or runners, that support the entire length of the top horizontal member. Two of the runners form a center support, and two of the runners form diagonal supports. Each diagonal support member forms a leg of an isosceles triangle with each vertical side support stringer member forming the other leg. The diagonal support members give added strength to the pallet and assist in distributing the load placed upon the pallet.

18 Claims, 3 Drawing Sheets

CORRUGATED PALLET

FIELD OF THE INVENTION

The present invention relates to corrugated pallets and, more particularly, to a low cost, light weight, rugged, corrugated pallet for loading and transporting materials.

BACKGROUND OF THE INVENTION

There are several advantages of using corrugated pallets, rather than those consisting of wood, for transporting materials. The corrugated pallet weighs much less than its wooden counterpart, which greatly reduces transportation costs and makes it easier to handle. In addition, after it wears out, it can be recycled in most municipalities. Furthermore, the corrugated material is safer to handle, since there are no splinters, as with wood.

All of the corrugated pallets that are on the market today require expensive steel rule cutting dies in their manufacture. The use of steel rule dies limits the number of sizes that can be fabricated, since the cost of the dies must be amortized over the number of pallets manufactured. The higher cost reduces their attractiveness, as an alternative to the wood pallets. In addition, expensive tooling increases the lead time in getting the pallets from the supplier.

Another disadvantage with present day corrugated pallets is relatively low durability and short operative life. Their glue bonds are directly stressed by the forklift trucks (such as blocks or runners), causing frequent repairs.

The pallet of the present invention does not require any tooling in its fabrication, and is therefore inexpensive to manufacture. The inventive pallet can be sized to the load, which improves the costs of transportation.

The pallet comprises diagonally shaped runners disposed along the length of the pallet. These runners act to stiffen and strengthen the pallet. The angle of these runners tends to disperse the load of the forklift blades, when the forklift truck comes into load contact therewith. The dispersion of load forces reduces the probability of damage to the pallet. This force dispersion, combined with a strengthening adhesive disposed in a pattern about the pallet, provides the pallet with high strength and durability. The pallet is designed for loads ranging from 70 to 250 pounds.

DISCUSSION OF RELATED ART

In U.S. Pat. No. 3,464,371, issued to Gifford on Sep. 2, 1969, for DISPOSABLE PALLET, a pallet is illustrated having blocks of corrugated fiberboard. The fiberboard is either slit, scored or glued together to form blocks.

The pallet of the invention differs from the aforementioned patent, in that the load capacity is derived from the outside edge of the pallet, coupled with the angular support and the middle double thick support. In the patent, the pieces of corrugation act like wood to provide the stiffening.

In U.S. Pat. No. 5,365,857, issued to Kilpatrick et al on Nov. 22, 1994, for PALLET STRINGER, a corrugated pallet is shown. The pallet is fabricated from a paperboard sheet having five panels on each side of a vertical plane. The patent uses an angular approach to make beam structures resembling wood boards of a wooden pallet. Several separate pieces act as the runners. The flat corrugated sheets are used for the deckboards. Special notching is needed to construct the pallet, which is fabricated using a steel ruled die. The angled beam always ends flat against a corrugated upright member.

In U.S. Pat. No. 5,406,892, issued to Kilpatrick et al on Apr. 18, 1995, for PAPERBOARD PALLET WITH HALF STRINGERS, a pallet is illustrated which is similar to that shown in aforementioned U.S. Pat. No. 5,365,857. The beam structure of this patent also ends flat against the corrugated upright member. The angled beams and flat sheets of corrugation are also similar in design to the previously described patent.

In U.S. Pat. No. 5,377,600, issued to Speese et al on Jan. 3, 1995, for PALLET AND PALLET RUNNER OF CORRUGATED CARDBOARD, a rectangular shaped pallet deck is illustrated. Some of the load capacity is developed with addition of cores, blocks and other materials, for stacking strength. The pallet requires a steel ruled die for its manufacture.

In Finish Patent No. 26164, issued to Cahners on Nov. 30, 1953, a block style pallet is shown. The pallet has blocks or cores adhered to a top deck sheet. There is no bottom structure under the blocks. Also, rectangular beams are illustrated. They include an angular piece on the interior that ends flat in the corner of the rectangle. This large, one-piece construction requires a die to make the pallet. Much board waste occurs in between the material that makes up the rectangular blocks.

In the U.S. Pat. No. 2,444,183, issued to Cahners on Jun. 29, 1948, for FIBERBOARD PORTABLE PLATFORM, a one-piece pallet is shown that is similar in appearance to the invention. Being of one piece, the pallet requires a large, expensive die in order to manufacture it. This will also result in a great deal of scrap occurring between the protrusions. The angled piece starts at the corner of the vertical, weakening the entire structure, since the edge of the corrugation can easily roll and deform. By contrast, the present invention starts and ends on the bottom of the center support and has separate pieces for the bottom boards on the pallet. This allows for a stronger, continuous angle. The separate pieces on the bottom eliminate the need for a large die, which, in turn, eliminates scrap material. In addition, the present invention uses modern day adhesives which strengthen the top deck, and which were probably unavailable at the time of the patent.

SUMMARY OF THE INVENTION

In accordance with the present invention, there is provided a corrugated pallet that is low in cost, yet strong, and light in weight. The pallet comprises an assembly having an upper and lower deck. The lower deck has a bottom segment and at least two upright end stringers. Alternatively, to increase the strength of the pallet, a full length bottom segment may be used with fork trucks or when handtruck wheels can be fully extended through the entire pallet. The upper deck has a top side and at least three downwardly positioned support members, one of which is a center support member. At least two of the support members form runners that combine with the lower deck to form acute angles with the lower and upper decks adjacent the end stringers. The angle of these runners tends to distribute or disperse the load of forklift blades when a forklift truck comes into load contact with the pallet. The distribution or dispersion of the load forces also reduces the probability of damage to the pallet. This dispersion, combined with a strengthening adhesive disposed in a pattern about the pallet, provides the pallet with high strength and durability. The pallet is designed for loads ranging from 70 to 250 pounds. The upper and lower deck members are substantially parallel to each other and are separated along their length by the center support member. The vertical side support members support the entire length of the top horizontal deck member and the two diagonal support members. Each diagonal support member comprises one leg of an isosceles triangle, the respective side stringer forming the other side of the isosceles triangle. The pallet is low cost by virtue of the assembly which is formed by using only a minimum number of folded sections, to wit: one piece folded to form the entire top horizontal deck member, a center support member, and the two diagonal support members. Alternatively, to increase the strength of the pallet, a full length bottom segment may be used with fork trucks or when handtruck wheels can be fully extended through the entire pallet. Each vertical end support member requires only a folded section spanning one end, the base, and the other end.

It is an object of this invention to provide an improved corrugated pallet.

It is another object of the invention to provide a corrugated pallet that is easy to manufacture and is inexpensive to fabricate.

It is a further object of this invention to provide a rugged, durable, corrugated pallet having a long operative life.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numbering and designations throughout the figures.

DESCRIPTION OF THE PREFERRED EMBODIMENT

Generally speaking, the invention features a pallet that is made of corrugated material having two horizontal, upper and lower deck members that are substantially parallel to one another. The deck members are separated along their length by a center support member, two vertical, side support, stringer members, and at least three separate internal members, or runners, that support the entire length of the top horizontal member. Two of the runners form a center support, and two of the runners form diagonal supports. Each diagonal support member forms a leg of an isosceles triangle with each vertical side support stringer member forming the other leg. The diagonal support members give added strength to the pallet and assist in dispersing the load placed upon the pallet.

Figure 1:
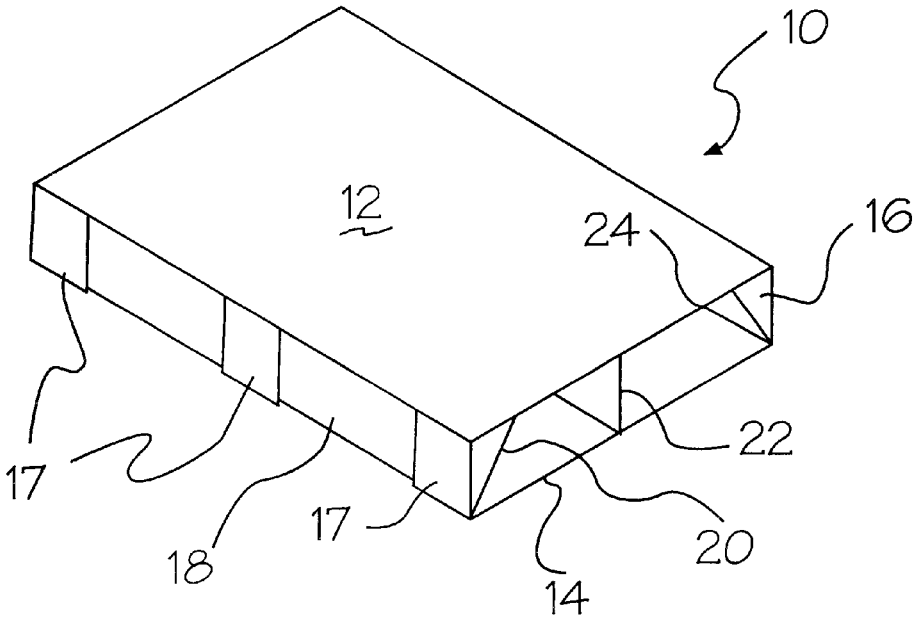
FIG. 1 illustrates a perspective schematic view of the pallet of this invention.
Figure 2:
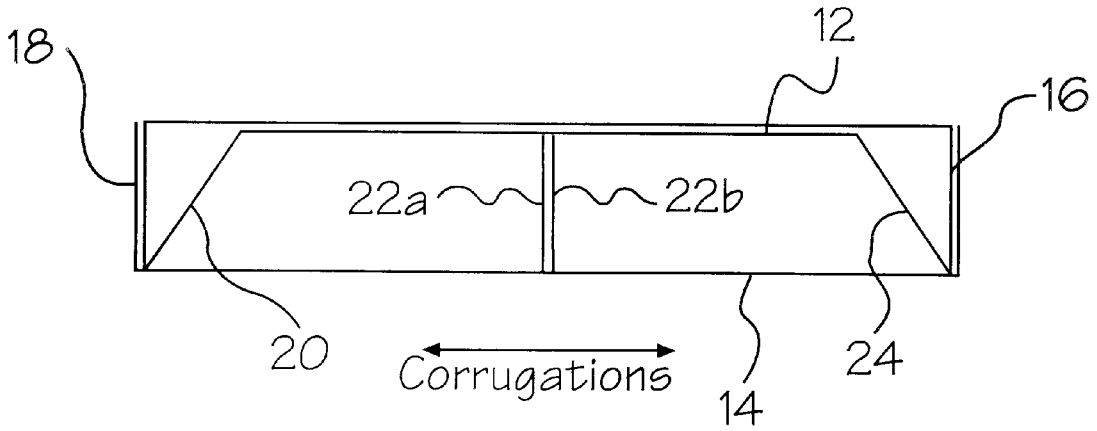
FIG. 2 depicts a front view of the pallet shown in FIG. 1.

Now referring to FIGS. 1 and 2, the corrugated pallet 10 of this invention is shown. The pallet 10 comprises an upper deck 12 and a lower deck 14. The decks 12 and 14 are substantially parallel with respect to each other. Two side members, or stringers 16 and 18, support the decks 12 and 14 and form the rectangular shape of the pallet 10. Disposed on each of the side members 16 and 18 are three spaced-apart deckboards 17. The deckboards 17 add stiffening to the side members 16 and 18, respectively.

Three runner elements 20, 22, and 24 are internally disposed between the decks 12 and 14. The center, or vertical runner 22, has two vertical members 22*a* and 22*b*, as better observed with respect to FIG. 4. Cold glue is disposed between the two center members 22*a* and 22*b*, to provide stiffening. The other two runners 20 and 24 form diagonal supports with respect to the horizontal decks 10 and 12 and the vertical, side stringers 16 and 18. The runners 20 and 24 each form one leg of an approximate isosceles triangle with respect to the upper deck 12. The other leg of the isosceles triangle is formed by the respective side stringers 16 and 18.

Figure 3:
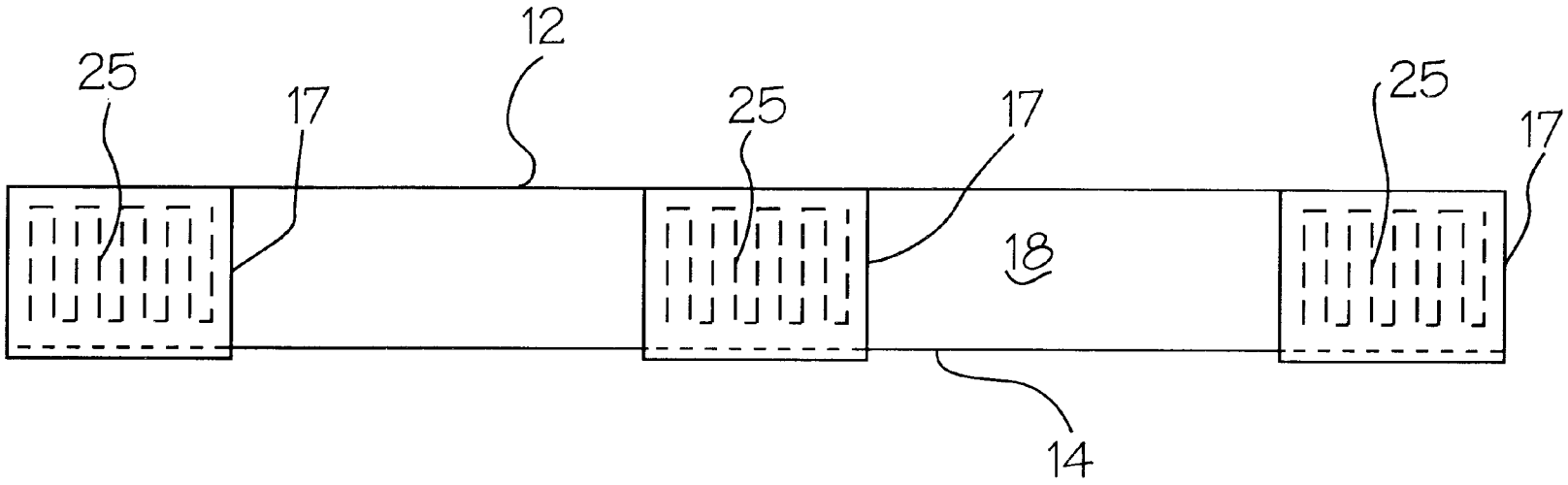
FIG. 3 shows a side view of the pallet depicted in FIG. 1.

Referring to FIG. 3, a side view of the pallet 10 is illustrated. There are six deckboards 17, three on each side 16 and 18. Each deckboard 17 is coated with a serpentine pattern 25 comprising a hot melt glue, as shown. The hot melt glue pattern 25 provides a stiffening to the deckboards 17, which in turn provides a stiffening to the side stringer members 16 and 18.

Figure 4:
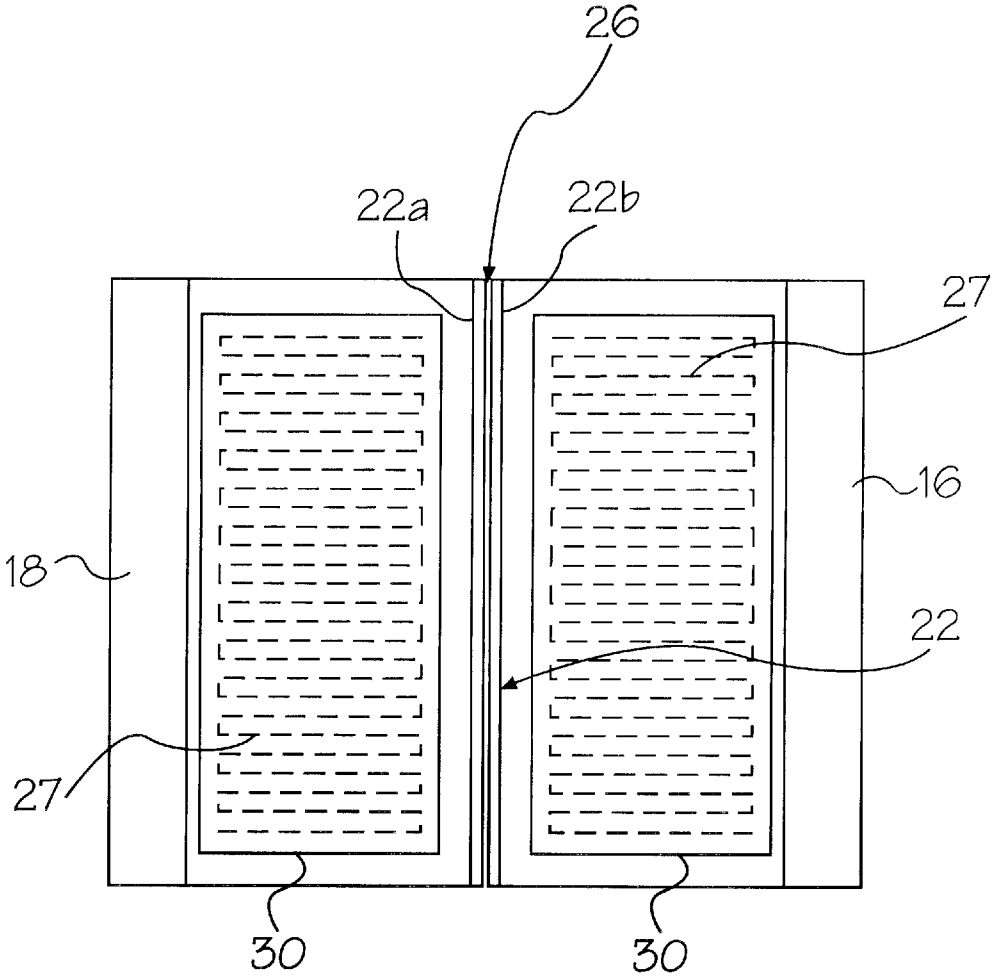
FIG. 4 illustrates a bottom view of the pallet shown in FIG. 1, with the bottom deckboards removed.

Referring to FIG. 4, a view of the underside of the upper deck 12 is shown. As aforementioned, cold glue is coated in the slot 26 between the center support runner members 22*a* and 22*b*. Cold glue is also deposited in a rectangular serpentine pattern 27 on both sides of the center support 22. A hot melt bead 30 of glue is coated around the perimeter of each cold glue serpentine pattern 27. The glue coatings 27 and 30 provide stiffening to the upper deck 12, which is reinforced by the center support runner 22, which also is stiffened by cold glue disposed within slot 26, as aforementioned.

The corrugated pallet 10 is inexpensive to fabricate by virtue of using only a minimum number of folded sections in its assembly, to wit: one piece folded to form the entire top horizontal deck member 12, a center support member 22, and the two diagonal support members 20 and 24. Each vertical end support member 16 and 18 requires only a folded section spanning one end, the base 14, and the other end.

During initial testing of the pallet 10, the following results were observed:

Compression—2200 lbs.

Shock with 150 lb. load—Bottom drops of 28 and 40 inches.

Passed a very abusive forklift truck handling test without any problems, and were superior to other pallets tested.

The cost savings based on comparing a wood pallet and its shipment to the new pallet 10 are $6.00 to $7.00 per load depending on the actual weight. This includes pallet and transportation costs.

Hot glue, normally referred to as a hot melt adhesive, is dispensed from a gun as a bead or on a heated wheel that turns in a glue tub. This type of glue hardens and sets up relatively quickly.

Cold glue, normally referred to as white or "Elmers™" type glue is less expensive than hot melt adhesive and easier to handle for a large area. It takes much longer, however, to harden and to set up than does hot melt adhesive. The greater time period required for cold glue to harden also has a positive effect on strengthening the bond between corrugated surfaces. Cold glue can be applied with a bead-producing applicator or a brush.

Cold glue is used for large areas, in order to reduce costs. A longer setup time allows the assembler to spread it more uniformly. Hot melt adhesive, on the other hand, sets up more quickly, allowing the assembler to complete manufacture of the pallet is less time.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A corrugated pallet comprising an assembly having an upper and lower deck, said lower deck having a bottom segment and at least two upright end stringers, said upper deck having a top side and at least three downwardly positioned support members, said upper deck having at least one serpentine pattern of glue coated thereupon, one of said support members being a center support member, and the other two support members forming acute angles with respect to said respective lower and upper decks adjacent said respective upright end stringers.

2. The corrugated pallet in accordance with claim 1, wherein each of said two diagonal support members comprises one leg of an isosceles triangle with respect to its respective upright end stringer, said respective upright end stringer forming the other side of the isosceles triangle.

3. The corrugated pallet in accordance with claim 1, wherein said center support member comprises two support elements and means defining a slot therebetween, said slot comprising glue disposed therein.

4. The corrugated pallet in accordance with claim 1, wherein said glue perimeter is substantially rectangular.

5. The corrugated pallet in accordance with claim 1, wherein each of said end stringers comprises a plurality of deckboards.

6. The corrugated pallet in accordance with claim 5, wherein each of said deckboards is coated with a glue.

7. The corrugated pallet in accordance with claim 6, wherein each of said deckboards that is coated with a glue is coated with a pattern.

8. The corrugated pallet in accordance with claim 6, wherein each coated glue pattern is serpentine.

9. The corrugated pallet in accordance with claim 1, wherein three deckboards are on each end stringer.

10. The corrugated pallet in accordance with claim 1 wherein only one piece of corrugated material is contained in said upper deck, said only one piece of material being folded to form the entire upper deck, said center support, and said two diagonal support members.

11. The corrugated pallet in accordance with claim 1, wherein each end support stringer comprises only a single piece of folded material.

12. The corrugated pallet in accordance with claim 1, wherein said at least one pattern of glue coated upon said upper deck has a glue perimeter.

13. A corrugated, glue reinforced, pallet comprising an assembly having an upper and lower deck, said lower deck having a full length bottom segment, said upper deck having a top side and at least three downwardly positioned support members, one of which is a center support member, and the other two support members forming acute angles with respect to said respective lower and upper decks, and wherein said upper deck is reinforced with glue wherein said upper deck comprises at least one serpentine pattern of glue coated thereupon.

14. The corrugated pallet in accordance with claim 13, wherein each of said two diagonal support members comprises one leg of an isosceles triangle.

15. The corrugated pallet in accordance with claim 13, wherein said center support member comprises two support elements and means defining a slot therebetween, said slot comprising glue disposed therein.

16. The corrugated pallet in accordance with claim 13, wherein only one piece of corrugated material is contained in said upper deck, said only one piece of material being folded to form the entire upper deck, said center support, and said two diagonal support members.

17. The corrugated pallet in accordance with claim 13, wherein said at least one pattern of glue coated upon said upper deck has a glue perimeter.

18. The corrugated pallet in accordance with claim 17, wherein said glue perimeter is substantially rectangular.

* * * * *